United States Patent [19]

Breslow

[11] Patent Number: 4,712,694

[45] Date of Patent: Dec. 15, 1987

[54] DISPLAY SHELF ORGANIZER

[75] Inventor: David Breslow, Chicago, Ill.

[73] Assignee: RTC Industries, Inc., Chicago, Ill.

[21] Appl. No.: 929,053

[22] Filed: Nov. 10, 1986

[51] Int. Cl.[4] ..... A47F 5/00

[52] U.S. Cl. ..... 211/184; 40/10 R; 40/16.2; 108/61

[58] Field of Search ..... 211/184, 43; 108/60, 108/61; 312/140.3, 140.4; 40/16.2, 10 R

[56] References Cited

U.S. PATENT DOCUMENTS

| | | | |
|---|---|---|---|
| 2,730,825 | 1/1956 | Wilds | 40/16.2 |
| 3,339,746 | 9/1967 | McCabe | 211/43 |
| 3,868,021 | 2/1975 | Heinrich | 312/140.3 X |
| 4,488,653 | 12/1984 | Belokin | 211/184 |
| 4,615,276 | 10/1986 | Garabedian | 211/184 X |

*Primary Examiner*—Robert W. Gibson, Jr.

*Attorney, Agent, or Firm*—Dressler, Goldsmith, Shore, Sutker & Milnamow, Ltd.

[57] ABSTRACT

A shelf organizer assembly comprising but two elements, each of which is integrally molded, preferably of clear plastic materials. One element is an L-shaped rail member having a horizontal foot connectable to a shelf and a vertical rail leg. The rail leg has integrally formed rails to provide a channel on the inner face thereof. The second element comprises an elongated divider panel having an I-shaped mounting flange integral with its front edge. The flange is resiliently compressible so that the same is snap-fittable into the rails to operationally mount the panel. The panel also includes break-off grooves for selectively shortening the same and a footing flange which cooperates with the horizontal foot of the rail member to prevent angular movement of the operationally mounted panel.

7 Claims, 3 Drawing Figures

DISPLAY SHELF ORGANIZER

TECHNICAL FIELD

This invention relates to merchandise display shelves and, more particularly, to an improved device for organizing and dividing existing display shelves.

BACKGROUND OF THE INVENTION

In recent years, there has been a growing trend toward self service merchandising. Thus, for example, in a wide variety of stores, such as, groceries, supermarkets, drugstores, multi-department stores, and the like, the merchandise is displayed on shelves from which the customer selects the desired merchandise and brings it to a central check-out counter or cashier. Efficient use of the shelf space and the organized and appealing representation of the products displayed thereon is essential for effective merchandising of this type.

Typically, an elongated shelf of a standard length (perhaps three or four feet) will be subdivided by vertical walls or dividers to provide bins of suitable widths to accommodate the various products being displayed therein. Also each bin desirably carries easily visible information relating to pricing, advertising copy, or other consumer information for the particular product. Since product shapes and sizes vary greatly and since inventories, promotions, and sales are constantly changing, there is a need for virtually infinite and quick adjustability of the shelf organization.

Conventional shelving customarily is made of sheet metal or, in some instances, wood and represents a relatively long term and substantial financial investment. Obviously, it is not feasible to replace such shelving whenever changes in organization of adjustability are desired. There thus exists a need for an improved and relatively inexpensive organizer device which can be readily attached to existing conventional shelving.

SUMMARY OF THE INVENTION

The present invention provides a shelf organizer device which may be readily attached to existing conventional shelving and yet is capable of virtually infinite bin width adjustability.

Briefly, the shelf organizer comprises a two-element assembly, namely, a front stop rail and a vertical divider. A plurality of such dividers are adapted to be slidably and releasably retained by the stop rail. The stop rail includes a horizontal leg attachable to an existing shelf and a vertical front face. The front face comprises a longitudinal channel on its inner surface adapted to receive the front portion of the vertical divider.

The divider comprises a front edge having top and bottom I-shaped flanges slidably receivable in the stop rail channel. Resilient means comprising a relief cut-out opening in the front edge of the divider permits snap-fitting connection and disconnection of the divider from the stop rail channel. A longitudinal T-shaped flange is formed at the bottom of the divider and is shaped to cooperate with the stop rail leg to limit lateral movement and also serves to rigidify the divider panel.

The divider panel comprises further sets of break-off grooves which permit the divider to be readily shortened without the use of tools where the shortened depth of any particular shelving so requires.

Both elements of the organizer preferably are made molded of available clear plastics. As a result, the stop rail channel serves a dual function, namely, the retention of product information cards, or the like, which are readily legible to the customer and yet protected from intentional or inadvertent abuse or damage.

Numerous other advantages and features of the present invention will become readily apparent from the following detailed description of the invention, from the claims, and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

Figure 1:
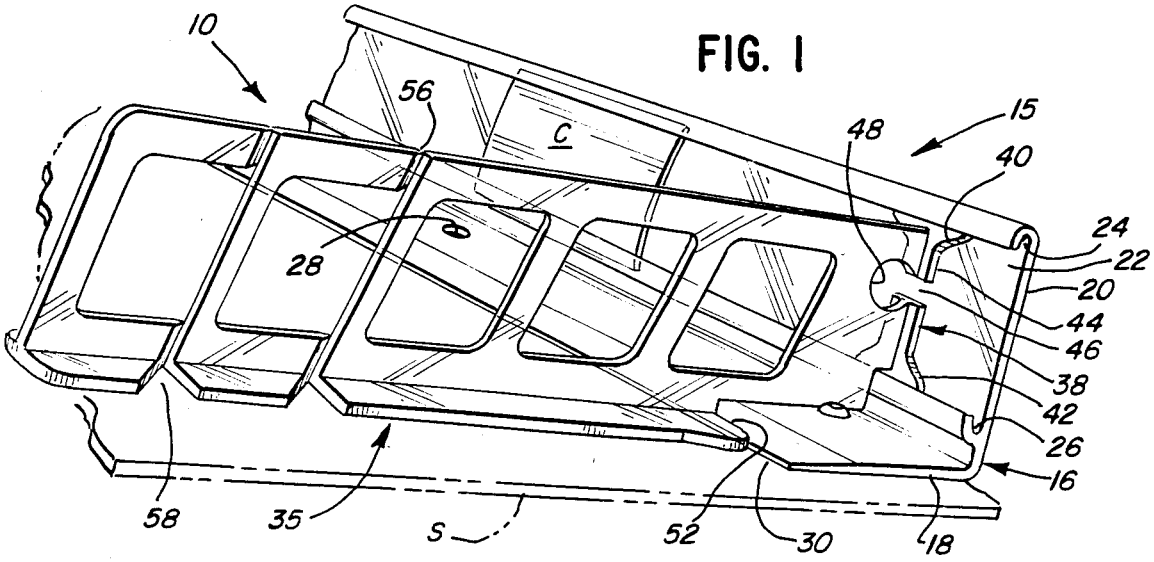
FIG. 1 is a fragmentary perspective view of a display shelf organizer showing the same operationally mounted on a display shelf.
Figure 2:
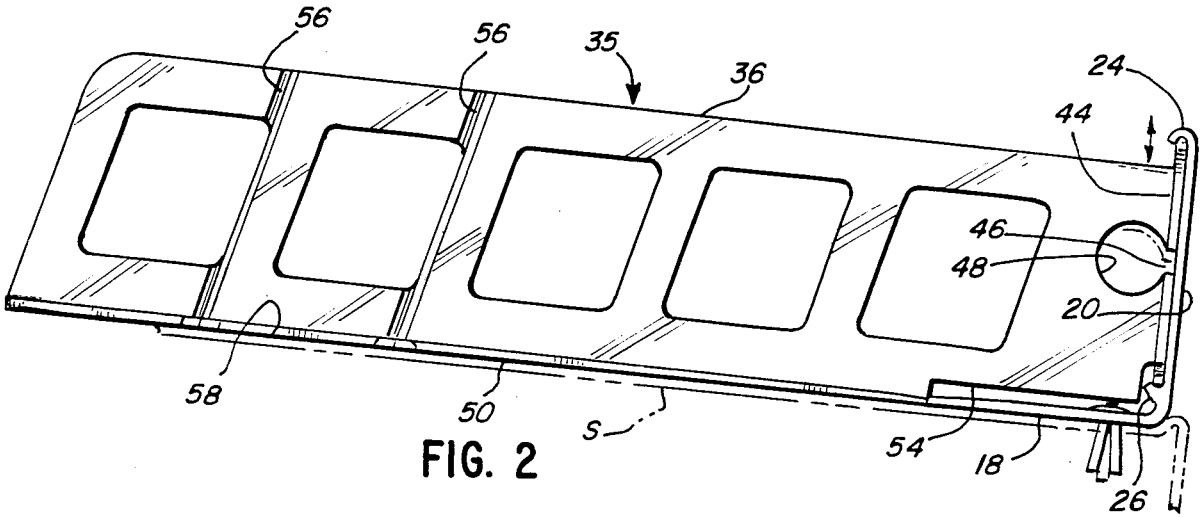
FIG. 2 is a side elevational view.

Referring with greater particularity to the figures of the drawings, it will be seen that the reference numeral 10 indicates generally a shelf organizer embodying the principles of the invention. Shelf organizer 10 comprises but two parts, a front rail member 15 and vertical divider member 35, a plurality of the divider members being connectable to the rail member to provide an operational assembly in a manner to be described.

Rail member 15 comprises an elongated L-shaped member 16 having a horizontal mounting foot 18 and a vertical rail leg 20. Rail leg 20 comprises an integral channel 22, said channel being provided by a top rail 24 and a bottom rail 26 projecting from the inner face of said rail leg. The rail member 15 preferably is made in standardized lengths, such as, two feet, or three feet, and the leg 18 is formed with spaced mounting holes, such as 28. Operational mounting of the rail member 15 to the front edge of a shelf S may be readily made by aligning the mounting holes 28 with similar holes already existing or made in the shelf and passing suitable connectors therethrough, such as, screws, or the resilient press rivets illustrated. The rail leg 18 preferably tapers rearwardly to a relatively thin rear edge 30 and thereby provides minimal resistance to products on shelf S being slid thereover onto the leg.

In the illustrated embodiment, which is not limiting, the divider member 35 comprises an elongated panel 36 of vertical height substantially equal to the height of rail leg 20. At its front edge, the panel 36 comprises an integral I-shaped mounting flange 38 having top and bottom branches 40 and 42 and a stem 44. It will be noted that the stem 44 is not continuous but is interrupted by a gap 46. A circular cut-out 48 is formed in a front portion of the panel 36 and said cut-out opens to the gap 46 in the stem 44. The cut-out 48 functions as a relief hole, thereby permitting a limited amount of resilient compressibility between the interrupted segments of the mounting flange stem 44. As a result of the described resilience and compressibility, the mounting flange branches 40 and 42 may be readily snap-fit into the rails 24 and 26, whereupon the branches spring back to engage the rails with the flange lying in face-to-face contact with the inner face of the rail leg. The said operational connection of the divider 35 in the channel 22 likewise permits lateral sliding of the divider to any desired position. It should also be noted that the operationally connected divider 35 may be readily disconnected, if desired by compressing the flange stem to free a branch 40 or 42 from its associated rail.

The panel 36 comprises further an inverted T-shaped footing flange 50 having a widened front edge 52 and a raised segment 54 which accommodates the rail leg 20 thereunder. The footing flange 50 contacts the shelf S to aid in the vertical standing of the divider and provides linear rigidity to the panel 36, while the front edge 52 of said flange bears against the rear leg edge 30 to prevent angular movement of the panel.

Figure 3:
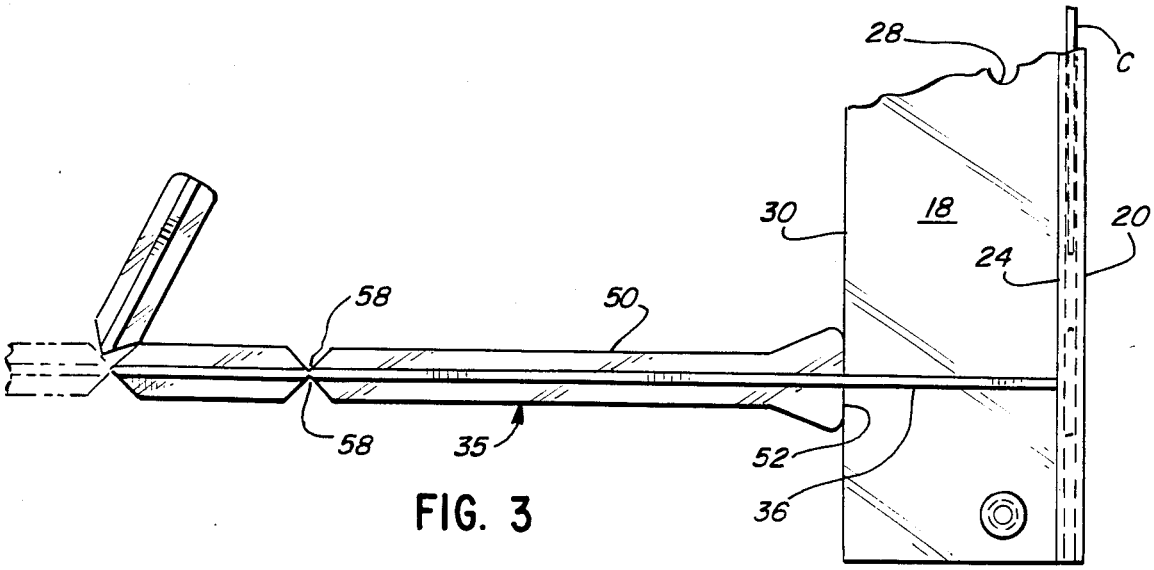
FIG. 3 is a fragementary top plan view.

The divider members 35 preferably are made in a standard length corresponding to the common depth of existing shelving, such as, twelve inches. However, in the event shorter dividers are required, the panel 36 is provided with self-contained means for achieving such shortening. Adjacent the rearward portion of the divider member 35, the panel 36 comprises one or more break-off grooves 56 and the footing flange 50 is formed with aligned V-shaped notches 58 communicating with said grooves. One or more sections of the panel 36 thus may be readily broken away to provide a shorter divider if desired (see FIG. 3).

Each of the members 15 and 35 preferably is integrally molded from suitable available transparent plastics. As a result, the channel 22 of the rail member 15 is adapted to serve a dual function. Thus, as seen in FIG. 1, flexible information cards such as C may be inserted in the channel 22, whereupon they are legible to the consumer while being protected from external mutilation.

It should, of course, be appreciated that a plurality of divider members 35 typically will be operationally assembled to a rail member 15 to provide the number and dimension of product bins desired.

It will be appreciated from the foregoing detailed description of the invention and illustrative embodiment thereof that numerous variations and modifications may be effected without departing from the true spirit and scope of the novel concept of the principles of the invention.

What is claimed is:

1. A shelf organizer comprising:

an elongated rail member having a bottom mounting portion and an upper portion extending upwardly from the mounting portion, said mounting and upper rail portions together defining a generally L-shaped cross-section for said rail member, said mounting portion being attachable to an upper surface of a shelf;

channel means comprising a top rail and an opposed bottom rail integrally formed on an inner surface of said upper rail portion wherein said top rail is generally coextensive with the upper edge of said upper rail portion, and wherein said bottom rail is generally coextensive with the lower extend of said upper rail portion; and an elongated divider member comprising an elongated panel and having resilient connector means integral with a front edge thereof, said connector means including vertically spaced upper and lower flange means respectively positionable in said top and bottom rails, said panel being configured to permit said upper and lower flange means to be resiliently compressed toward ech other so that said flange means are snap fittable in said channel means to operationally mount said divider member in a substantially vertical orientation and perpendicular to said rail portion, whereby said divider member substantially spans the vertical extent of the upper rail portion.

2. A shelf organizer according to claim 1 wherein said panel comprises an inverted T-shaped footing flange integral with the bottom edge of said panel, said footing flange having a widened front edge adapted to cooperate with the mounting portion of said rail member to prevent angular movement of the operationally mounted divider member.

3. A shelf organizer according to claim 2 wherein said panel comprises a break-off groove in a rear portion thereof and a pair of aligned V-shaped notches in said footing flange communicating with said groove, whereby a rear portion of said panel may be broken off to shorten said panel.

4. A shelf-organizer comprising:

an elongated L-shaped rail member having a horizontal mounting foot and a vertical rail leg, said mounting foot being attachable to a shelf;

a top rail and an opposed bottom rail integrally formed on the inner face of said rail leg;

an elongated divider panel having a substantially I-shaped mounting flange integral with the front edge thereof, said mounting flange comprising top and bottom branches and a vertical stem having an intermediate gap formed therein; and a cut-out in a front portion of said panel and opening said gap, whereby said flange stem is resiliently compressible to permit the snap-fitting of said flange branches into said rails for operational mounting of said panel to said rail leg.

5. A shelf organizer according to claim 4 wherein said rail leg is transparent and an information card operationally retained in said rails, whereby said information card is legible through said rail leg.

6. A shelf organizer according to claim 4 wherein said panel comprises an inverted T-shaped footing flange integral with the bottom edge thereof, said footing flange having a widened front edge adapted to cooperate with a rear edge of said mounting foot to prevent angular movement of the operationally mounted panel.

7. A shelf organizer according to claim 6 wherein said panel comprises a break-off groove in a rear portion thereof and a pair of aligned V-shaped notches in said footing flange communicating with said groove, whereby a rear portion of said panel may be broken off to shorten said panel.

* * * * *

UNITED STATES PATENT AND TRADEMARK OFFICE

CERTIFICATE OF CORRECTION

PATENT NO. : 4,712,694 Page 1 of 2

DATED : December 15, 1987

INVENTOR(S) : David Breslow

It is certified that error appears in the above-identified patent and that said Letters Patent is hereby corrected as shown below:

The Title Page should be deleted to appear as per attached Title Page.

Signed and Sealed this

Twenty-sixth Day of July, 1988

*Attest:*

DONALD J. QUIGG

*Attesting Officer*

*Commissioner of Patents and Trademarks*

United States Patent [19]

Breslow

[11] Patent Number: 4,712,694

[45] Date of Patent: Dec. 15, 1987

[54] DISPLAY SHELF ORGANIZER

[75] Inventor: David Breslow, Chicago, Ill.

[73] Assignee: RTC Industries, Inc., Chicago, Ill.

[21] Appl. No.: 929,053

[22] Filed: Nov. 10, 1986

[51] Int. Cl.[4] ..... A47F 5/00

[52] U.S. Cl. ..... 211/184; 40/10 R; 40/16.2; 108/61

[58] Field of Search ..... 211/184, 43; 108/60, 108/61; 312/140.3, 140.4; 40/16.2, 10 R

[56] References Cited

U.S. PATENT DOCUMENTS

| | | | |
|---|---|---|---|
| 2,730,825 | 1/1956 | Wilds | 40/16.2 |
| 3,339,746 | 9/1967 | McCabe | 211/43 |
| 3,868,021 | 2/1975 | Heinrich | 312/140.3 X |
| 4,488,653 | 12/1984 | Belokin | 211/184 |
| 4,615,276 | 10/1986 | Garabedian | 211/184 X |

*Primary Examiner*—Robert W. Gibson, Jr.

*Attorney, Agent, or Firm*—Dressler, Goldsmith, Shore, Sutker & Milnamow, Ltd.

[57] ABSTRACT

A shelf organizer assembly comprising but two elements, each of which is integrally molded, preferably of clear plastic materials. One element is an L-shaped rail member having a horizontal foot connectable to a shelf and a vertical rail leg. The rail leg has integrally formed rails to provide a channel on the inner face thereof. The second element comprises an elongated divider panel having an I-shaped mounting flange integral with its front edge. The flange is resiliently compressible so that the same is snap-fittable into the rails to operationally mount the panel. The panel also includes break-off grooves for selectively shortening the same and a footing flange which cooperates with the horizontal foot of the rail member to prevent angular movement of the operationally mounted panel.

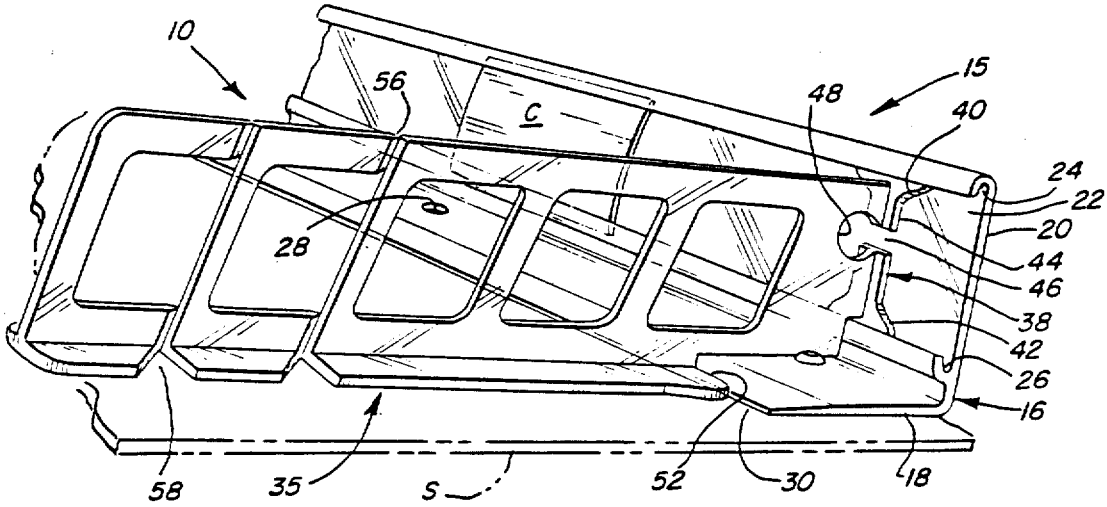

7 Claims, 3 Drawing Figures